US006104901A

United States Patent [19]

Imamiya

[11] Patent Number: 6,104,901

[45] Date of Patent: Aug. 15, 2000

[54] IMAGE FORMING APPARATUS WITH A SQUEEZE ROLLER FOR CONTROLLING A LIQUID DEVELOPER QUANTITY

[75] Inventor: Koji Imamiya, Kawasaki, Japan

[73] Assignees: Toshiba Tec Kabushiki Kaisha, Tokyo; Kabushiki Kaisha Toshiba, Kawasaki, both of Japan

[21] Appl. No.: 09/391,469

[22] Filed: Sep. 8, 1999

[30] Foreign Application Priority Data

Sep. 30, 1998 [JP] Japan ..... 10-279043

[51] Int. Cl.[7] ..... G03G 15/09

[52] U.S. Cl. ..... 399/249

[58] Field of Search ..... 399/249, 57, 237, 399/233; 430/117–118, 240, 241

[56] References Cited

U.S. PATENT DOCUMENTS

| | | | |
|---|---|---|---|
| 5,300,990 | 4/1994 | Thompson | 399/249 X |
| 5,335,054 | 8/1994 | Landa et al. | 355/279 |
| 5,424,813 | 6/1995 | Schlueter, Jr. et al. | 355/256 |
| 5,576,815 | 11/1996 | Teschendorf et al. | 355/256 |
| 5,655,192 | 8/1997 | Denton et al. | 399/240 |
| 5,666,616 | 9/1997 | Yoshino et al. | 399/240 |
| 5,745,826 | 4/1998 | Chang et al. | 399/237 |
| 5,899,606 | 5/1999 | Tano et al. | 399/239 |

FOREIGN PATENT DOCUMENTS

| | | |
|---|---|---|
| 58-47707 | 10/1983 | Japan . |
| 59-11111 | 3/1984 | Japan . |
| 5-44037 | 7/1993 | Japan . |
| 8-6404 | 1/1996 | Japan . |
| 10-73997 | 3/1998 | Japan . |

*Primary Examiner*—Quana Grainger
*Attorney, Agent, or Firm*—Foley & Lardner

[57] ABSTRACT

An image forming apparatus is provided with developing units of different colors. Each developing unit is made up of a developing roller and a squeeze roller located downstream of the developing roller with respect to the rotating direction of a photosensitive drum. The outer circumference of the squeeze roller is a resin layer whose surface roughness Rz is less than 3 $\mu$m. The squeeze roller is formed of a conductive material, and serves to remove a residual carrier solution from the photosensitive drum. The squeeze roller can be applied with a predetermined bias voltage. Due to the application of the bias voltage, a transfer medium is prevented from becoming dark in the background portion thereof, despite the use of small-diameter toner particles.

10 Claims, 3 Drawing Sheets

IMAGE FORMING APPARATUS WITH A SQUEEZE ROLLER FOR CONTROLLING A LIQUID DEVELOPER QUANTITY

BACKGROUND OF THE INVENTION

The present invention relates to an image forming apparatus which forms an image in a wet developing process using a liquid developer.

A copying apparatus that uses an electrostatic copying process is one example of an image forming apparatus. In this type of copying apparatus, an image on a document to be copied is represented in the form of image information that indicates the optically light and shade portions of the image. An electrostatic latent image is formed on a photosensitive body in accordance with the image information, and the electrostatic latent image is then visualized with toner (i.e., a developer), thus making a copy of the document. As a method for supplying toner to the electrostatic latent image, the use of a liquid developer is known in the art. The liquid toner is a solution in which toner particles are dispersed.

In comparison with an image forming apparatus that utilizes a magnetic brush phenomenon, an image forming apparatus that employs a liquid developer is advantageous in that it can use toner having small-sized particles and thus contributes to improvement of image quality. In addition, the image forming apparatus that employs a liquid developer ensures a high-speed image formation. Moreover, the liquid developer is improved in gradation reproducibility, and a high-definition image which is equal in quality to a printed image can be obtained. It should also be noted that the temperature at which the toner begins to soften is comparatively low, so that a fixing operation of an toner image is easy to perform.

A liquid developer is made up of toner particles and a carrier solution. This being so, there is room for improvement in regard to the present method in which the liquid developer is supplied to the electrostatic latent image, and the present method in which residual liquid toner (i.e., the carrier solution) remaining on the image bearer (photosensitive body) after the developing process is removed.

To remove the carrier solution that remains on the photosensitive drum after the developing process, a variety of methods have been proposed to date. One of them is a system which employs a non-contact metal roller, another is a nozzle suction system which utilizes air suction.

U.S. Pat. No. 5,576,815 discloses a squeeze system in which the carrier solution is squeezed out of a photosensitive body by means of an elastic roller. U.S. Pat. No. 5,335,054 discloses a setting mechanism wherein a toner image is set or fixed on the surface of a photosensitive drum by bringing an elastic roller formed of an elastic polymer into contact with the photosensitive drum.

If the residual carrier solution that is left on the photosensitive body is not removed after the developing process, it will form a layer having a thickness of 10 $\mu$m to 100 $\mu$m, though this thickness varies depending upon the type of an image forming apparatus employed and upon the process speed or other factors.

Unless the carrier solution is squeezed out of the photosensitive body, the carrier solution (liquid developer) stored in the developing device will be used up in a comparatively short period of time. In addition, the residual toner will become a cause of a toner image being distorted in the transfer process, resulting in a defective image. If the residual carrier solution is not completely squeezed and evaporates into the interior of the apparatus, it may give adverse effects on the movable portion, the metal portions, the electric circuit portions of the apparatus.

In the system employing a non-contact metal roller, a squeeze roller is kept arranged at a position about 50 $\mu$m away from the surface of the photosensitive body, and that squeeze roller is rotated in the same direction as the photosensitive body (which means that the outer circumferential surface of the photosensitive body and that of the squeeze roller are moved in the opposite directions in the region where they face to each other). In spite of the adoption of this system, however, it is likely that the residual carrier solution will form a layer of 2 $\mu$m to 4 $\mu$m on the photosensitive body.

The nozzle suction system which employs an air nozzle is expected to remove a residual carrier solution in a reliable manner when it is applied to an apparatus whose process speed is low. However, the apparatus incorporating the nozzle suction system is inevitably large since the nozzle suction system requires a suction apparatus comprising a vacuum pump as a suction source. If the nozzle suction system is applied to an apparatus whose process speed is high, the suction apparatus must have improved performance corresponding to the high process speed. Such a suction apparatus is not suitable for practical use since it gives rise to an increase in the power required and is noisy.

In the system employing elastic roller, the surface characteristic of the roller is a factor that plays an important role in the removal of the residual carrier solution. To be more specific, the surface of the roller is elastic; it is low in the degree of smoothness. If the surface roughness is represented as the value of Rz, it is in the range of 10 to 20 $\mu$m. As long as the roller has such a surface roughness, a satisfactory squeezing effect cannot be obtained.

BRIEF SUMMARY OF THE INVENTION

Accordingly, an object of the present invention is to provide an image forming apparatus which is of a type employing a liquid developer and which can clear the surface of a photosensitive body of a residual liquid developer in a reliable manner, thereby enabling the production of high-quality images.

To solve this object, the present invention provides an image forming apparatus comprising:

- a developing device which supplies a liquid developer including toner to an electrostatic image formed on an image bearer; and
- a squeeze roller including an elastic layer and a resin layer, a surface of the squeeze roller being moved in the same direction as a surface of the image bearer in a contact region where the squeeze roller is in contact with the image bearer, and serving to squeeze residual components of the liquid developer supplied to the electrostatic image from the developing device, the resin layer is harder than the elastic layer.

The present invention also provides an image forming apparatus comprising:

- a developing device which supplies a liquid developer including toner to an electrostatic image formed on an image bearer; and
- a squeeze roller including an elastic layer, a surface of the squeeze roller being moved in the same direction as a surface of the image bearer in a contact region where the squeeze roller is in contact with the image bearer, and serving to squeeze residual components of the liquid developer supplied to the electrostatic image from the developing device, the squeeze roller being applied with a predetermined bias voltage.

The present invention further provides an image forming apparatus comprising:

a developing device which supplies a liquid developer including toner to an electrostatic image formed on an image bearer; and a squeeze roller including an elastic layer, a surface of the squeeze roller being moved in the same direction as a surface of the image bearer in a contact region where the squeeze roller is in contact with the image bearer, and serving to squeeze residual components of the liquid developer supplied to the electrostatic image from the developing device, the squeeze roller being applied with a predetermined bias voltage and serving to charge a photosensitive layer of the image bearer such that the photosensitive layer has a predetermined potential.

Moreover, the present invention provides a squeeze roller for use with a developing device, comprising:

a metallic shaft serving as a rotating shaft;

a cylindrical elastic member made of rubber and provided around the outer circumference of the metallic shaft; and an outer sheath tube formed of a conductive resin which is harder than the elastic member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
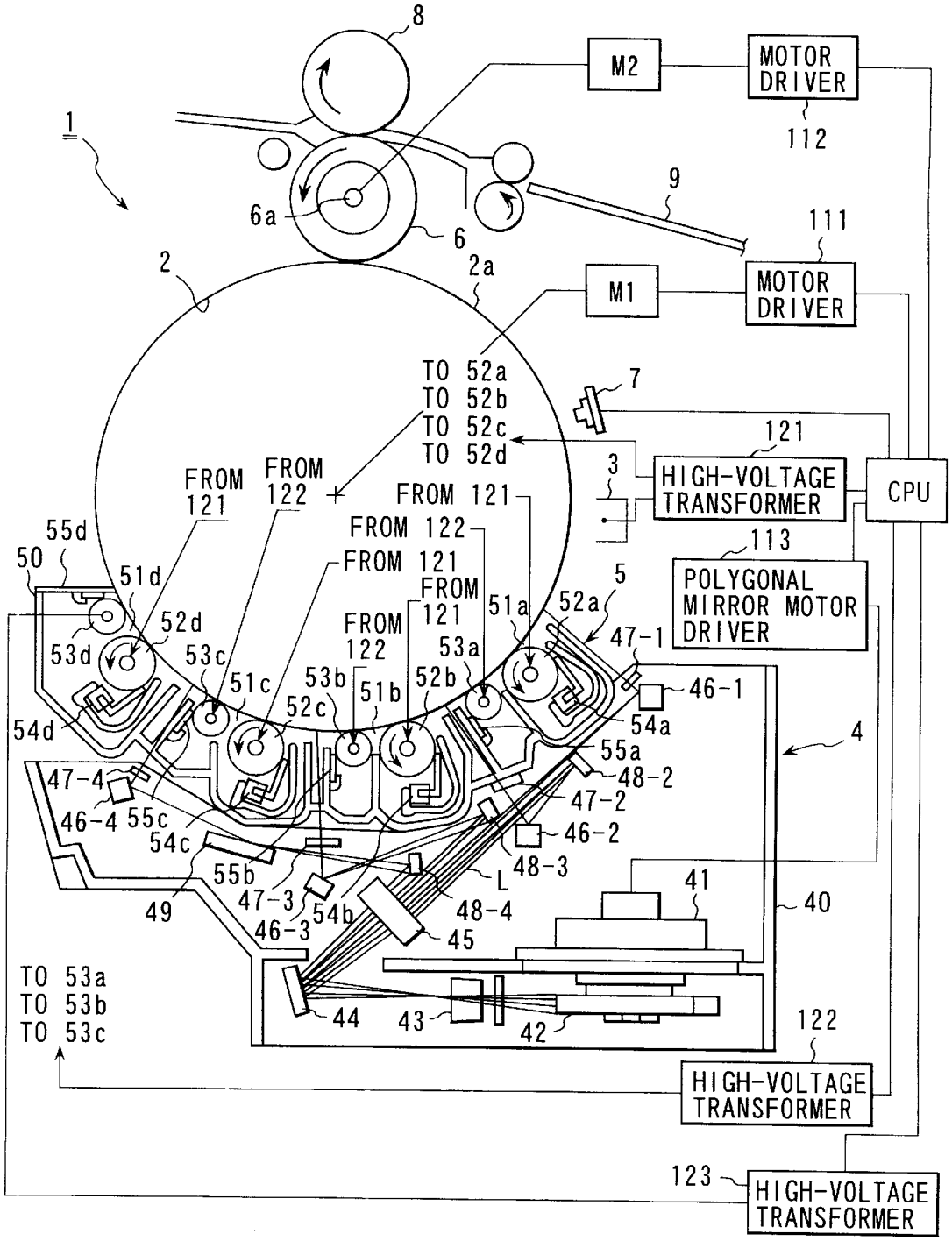
FIG. 1 is a schematic illustration showing an example of a color image forming apparatus to which a developing device according to one embodiment of the present invention is applied.

FIG. 1 is a schematic illustration showing an example of a color image forming apparatus to which a developing device according to one embodiment of the present invention is applied.

As shown in FIG. 1, an image forming apparatus 1 comprises a photosensitive drum 2 rotated in the direction of the arrow in accordance with rotation of a motor M1. Arranged around the photosensitive drum 2 are: a charging unit 3 for providing the photosensitive drum 2*a* on the surface of the drum 2 with a predetermined potential; an exposure unit 4 for exposing the photosensitive layer 2*a* to light reflecting an image and thereby forming an electrostatic latent image on the photosensitive layer 2*a*, after the photosensitive layer 2*a* is provided with the predetermined potential; a developing device 5 for developing the electrostatic latent image by supplying toner thereto, thereby forming an toner image; an offset roller 6 for transferring the toner image from the photosensitive layer 2*a* onto a transfer sheet; and a discharge LED 7 for removing the residual potential remaining on the photosensitive layer 2*a* of the photosensitive drum 2. These structural components are arranged in the rotating direction of the photosensitive drum in the order mentioned.

The photosensitive drum 2 is a cylindrical member, and the outer diameter of the drum 2, including the photosensitive layer 2*a*, is about 189 mm. The photosensitive drum 2 is rotated by the motor M1, which is controlled by a motor driver 111 connected to a CPU 101. The peripheral speed V1 of the photosensitive drum 2 is about 210 mm/s. The photosensitive material (not shown) of the photosensitive drum 2*a* is of a type that is charged in the same polarity as the toner mixed in a liquid developer (i.e., a developing solution), the details of which will be described later. In the present embodiment, the photosensitive material is of a type charged in the positive. The photosensitive layer can be formed of a known material, such as ZnO (zinc oxide), CdS (a cadmium-sulfur alloy), a-Si (amorphous silicon), OPC (an organic photosensitive member), or the like.

The charging unit 3 charges the photosensitive layer 2*a* of the photosensitive drum 2 to have a predetermined potential by radiating charges to the photosensitive layer 2*a*. The charges are supplied to the charging unit 3 from a high-voltage transformer 121.

The exposure unit 4 comprises the following structural elements: a polygonal motor 41 rotated at a given speed under the control of a polygonal mirror motor driver 113 connected to the CPU 101; a polygonal mirror 42 rotated at a given rate in accordance with the rotation of the motor 41; a first lens 43; a first mirror 44; a second lens 45, a second mirror 46 (i.e., a beam output mirror); a dust glass 47; a third mirror 48 (a first auxiliary mirror); a fourth mirror 49 (a second auxiliary mirror); and a housing 40 which contains all members in a sealed state together with the dust glass 47. A light beam L, emitted from a light source (not shown), is modulated in intensity in accordance with image data. The polygonal mirror 42 reflects and deflects this light beam L in the axial direction (not indicated in the drawings) of the photosensitive drum 2. By the deflected light beam, a linear electrostatic latent image of a predetermined width is formed on the photosensitive layer 2*a* of the photosensitive drum 2. Since the photosensitive layer 2*a* of the photosensitive drum 2 is rotated by the motor M1 at a given speed, it is exposed to the light beam L in such a manner that a scan takes place at predetermined intervals in the longitudinal direction of the photosensitive layer 2*a*. As a result, an electrostatic latent image is formed in the entire image formation area of the photosensitive layer 2*a*. The light beam L deflected (scanned) by the polygonal mirror 42 and passing through the first lens 43 is first reflected by the first mirror 44 and then passes through the second lens 45. Subsequently, the light beam L is divided into four beams corresponding to four color components, which will be developed by the four units of the developing device 5. The four beams and the optical paths along which they travel are as follows:

a) first beam . . . (mirror 46-1, glass 47-1)

b) second beam . . . (auxiliary mirror 48-2, mirror 46-1, glass 47-2)

c) third beam . . . (auxiliary mirror 48-3, mirror 46-3, glass 47-3)

d) fourth beam . . . (first auxiliary mirror 48-4, second auxiliary mirror 49, mirror 46-4, glass 47-7)

These four beams are radiated onto the photosensitive layer 2*a* of the photosensitive drum 2 through exposure slits formed in the housing of the developing device 5.

The developing device 5 is made up of first through fourth developing units 51*a*, 51*b*, 51*c* and 51*d*, which are contained inside the housing 50. By means of those developing units 51*a*, 51*b*, 51*c* and 51*d*, four images, each corresponding to a one-color image obtained by the color decomposition of an original image, are developed. Although not shown, liquid developer supply units are connected to the predetermined longitudinal positions of the developing units 51*a*, 51*b*, 51*c* and 51*d*. From the liquid developer supply units, the four-color liquid developers, each corresponding to one of the colors obtained by the color decomposition based on the subtractive color mixture, are supplied. The four colors are specifically yellow, cyan, magenta and black (the black developer is used for controlling the density).

Each of the developing units 51*a*, 51*b*, 51*c* and 51*d* will be described in detail.

The first, second and third developing units 51*a*, 51*b* and 51*c* comprise developing rollers 52*a*, 52*b* and 52*c* and squeeze rollers 53*a*, 53*b* and 53*c*, respectively. These rollers are arranged in the separate blocks inside the housing 50, respectively. Assuming that the photosensitive drum 2 is rotated in the clockwise direction as viewed in FIG. 1, the squeeze rollers 53*a*, 53*b* and 53*c* are located downstream of the developing rollers 52*a*, 52*b* and 52*c* with respect to the rotating direction of the drum 2.

The developing rollers 52*a*, 52*b* and 52*c* are arranged to face the photosensitive layer 2*a* of the photosensitive drum 2. The distances by which the developing rollers 52*a*, 52*b* and 52*c* are away from the photosensitive layer 2*a* are controlled by guide rollers (not shown), which have diameters slightly larger those of the developing rollers 52*a*, 52*b* and 52*c* and are in contact with the non-image formation region of the photosensitive layer 2*a* (i.e., longitudinal end portions of the photosensitive drum 2). The developing rollers 52*a*, 52*b* and 52*c* are driven by a driving force transmission mechanism (or by respective independent developing motors) in such a manner that the moving speed of each circumferential surface (i.e., the peripheral speed V2 of each developing roller) is twice as high as the peripheral speed V1 of the photosensitive drum. The directions in which the surfaces of the developing rollers are rotated are the same when they are looked at in the positions where the developing rollers are in contact with the photosensitive layer 2*a*. For example, the outer diameter of each developing roller is 21.7 mm and the outer diameter of the corresponding guide rollers is 22.0 mm. In this case, therefore, the distance Gd between the outer circumference of each developing roller and the photosensitive layer 2*a* is 150 $\mu$m. Cleaning members 54*a*, 54*b* and 54*c* are arranged at positions which are predetermined inside the respective separation blocks and at which they are kept in contact with the outer circumference of the developing rollers 52*a*, 52*b* and 52*c*. By the cleaning members 54*a*, 54*b* and 54*c*, the liquid developer, with which the electrostatic latent image on the photosensitive layer 2*a* is developed, is removed. That is, a developer is supplied from one of the liquid developer supply unit to the surface of the developing roller. After being used for the development of the latent image, the developer is removed from the surface of the developing roller by the corresponding cleaning member.

The surfaces of the developing rollers 52*a*, 52*b* and 52*c* are formed of a conductive material. At the time of development, the surfaces are applied with a positive developing bias voltage by the high-voltage transformer 121 connected to the CPU 101.

The squeeze rollers 53*a*, 53*b* and 53*c* are arranged substantially in parallel to the axis of the photosensitive drum 2 in such a manner that each of the squeeze rollers is in tight contact with the photosensitive layer 2*a* of the drum 2 at at least one longitudinal position. Each squeeze roller removes a residual liquid developer from the photosensitive drum 2 and applies a predetermined voltage to the photosensitive layer 2*a* of the drum 2. By the high-voltage transformer 101 connected to the CPU 101, each of the rollers 53*a*, 53*b* and 53*c* is applied with a voltage which is of the same polarity as the developing bias voltage (and which is of the same polarity as a charging voltage). Blades 55*a*, 55*b* and 55*c* are arranged on the outer circumferential surfaces of the squeeze rollers 53*a*, 53*b* and 53*c*, respectively. The blades 55*a*, 55*b* and 55*c* are in contact with the respective squeeze rollers with predetermined pressure so as to clean the surface of the squeeze rollers.

As will be detailed later with reference to FIG. 2, the squeeze rollers 53*a*, 53*b* and 53*c* are elastic rollers. Each squeeze roller is made up of a shaft 53-1 and an elastic body 53-2 provided around the shaft 53-1 and having a predetermined thickness. The shaft 53-1 is urged toward the photosensitive drum 2, with its ends pressed by push members such as springs. The squeeze roller is rotated at such a speed substantially that the surface moving thereof is substantially equal to that of the photosensitive layer 2*a*. Therefore, the surface moving speed of the squeeze roller (i.e., the peripheral speed V3 of the squeeze roller) is equal to the peripheral speed V1 of the photosensitive drum 2. If viewed at the position of contact, the surface moving direction of the squeeze roller is the same as that of the photosensitive drum 2 (the shafts of the roller and shaft are rotated in the opposite directions). Each squeeze roller is deformed at the position where it is in contact with the photosensitive layer 2*a*. The size of the deformed portion of the roller (i.e., the length of the outer circumference corresponding to the deformed portion) is generally referred to as a nip width, and the nip width is defined in the manner detailed later.

The squeeze rollers 53*a*, 53*b* and 53*c* can be pressed against the photosensitive layer 2*a* in a number of ways. For example, a guide roller having a smaller outer diameter than that of each squeeze roller may be used. In this case, the squeeze roller is pressed tightly against the photosensitive drum 2 by means of a spring or the like. Alternatively, the position of either the holder of the squeeze roller or that of the photosensitive drum 2 may be adjusted. By this adjustment, the shaft of the squeeze roller is arranged at a position closer to the photosensitive drum 2 than a position where the squeeze roller can touch the photosensitive layer without deformation (i.e., in the state where no pressure is exerted).

As will be detailed later with reference to FIG. 3, each of the squeeze rollers 53*a*, 53*b* and 53*c* may have a surface layer 53-3 which is electrically conductive and which is harder than the elastic body 53-2.

The fourth developing unit 51*d* comprises a developing roller 52*d* and a squeeze roller 53*d*. These rollers are arranged in the separate blocks inside the housing 50, respectively. Assuming that the photosensitive drum 2 is rotated in the clockwise direction as viewed in FIG. 1, the squeeze roller 53*d* is located downstream of the developing roller 52*d* with respect to the rotating direction of the drum 2. Since the structure of the developing roller 52*d* is similar to that of the first through third developing rollers 52*a*–52*c*, a detailed description of that structure will be omitted.

The squeeze roller 53*d* is arranged substantially in parallel to the axis of the photosensitive drum 2 in such a manner that it is in tight contact with the photosensitive layer 2*a* of the drum 2 at at least one longitudinal position. The squeeze roller 53*d* removes a residual liquid developer from the photosensitive drum 2 and applies a predetermined voltage to the photosensitive layer 2*a* of the drum 2. By a high-voltage transformer 101 connected to the CPU 101, the squeeze roller 53*d* is applied with a voltage which is of the same polarity as the developing bias voltage. Since the structure of the squeeze roller 53*d* is similar to that of the other squeeze rollers described above, no detailed description of that structure will be omitted. A blade 55*d* is arranged on the outer circumferential surface of the squeeze roller 53*d*. The blade 55*d* is in contact with the squeeze roller with predetermined pressure so as to clean the surface of the squeeze roller.

Like the other squeeze rollers, the squeeze roller 53*d* can be pressed against the photosensitive layer 2*a* in a number of ways. As described above, a guide roller having a smaller outer diameter than that of each squeeze roller may be used, and in this case, the squeeze roller is pressed tightly against the photosensitive drum 2 by means of a spring or the like. Alternatively, the position of either the holder of the squeeze roller or that of the photosensitive drum 2 may be adjusted in such a manner that the shaft of the squeeze roller is arranged at a position closer to the photosensitive drum 2 than a position where the squeeze roller can touch the photosensitive layer without deformation (i.e., in the state where no pressure is exerted).

The offset roller 6 has a predetermined diameter and is in contact with the photosensitive layer 2*a* of the photosensitive drum 2 in such a manner that the line of contact extends in the axial direction. The offset roller 6 is rotated by a second motor M2 under the control of a second motor driver 112 connected to the CPU 101. The offset roller 6 is rotated independently of the photosensitive drum 2. Although the surface moving direction of the offset roller 6 and that of the photosensitive roller are the same in the contact region, the rotating direction of the offset roller 6 is opposite to that of the photosensitive drum 2. In other words, the motors M1 and M2 are rotated in the opposite directions.

A transfer auxiliary roller 8 is arranged in contact with the outer circumference of the offset roller 6 and located away from the photosensitive drum 22. The transfer auxiliary roller 8 is pressed against the offset roller 6 with predetermined pressure by means of a pressing mechanism (not shown). The transfer auxiliary roller 8 is rotated in accordance with the rotation of the offset roller 6 while keeping tight contact therewith.

The discharge LED 7 is made of an array of LED elements arranged in the axial direction of the photosensitive drum 2. The LED elements can emit light having wavelengths suitable for canceling electric charges that are present on the photosensitive layer 2*a* of the photosensitive drum 2. Under the control of the CPU 101, the discharge LED 7 are lit at predetermined intervals, and the light therefrom is guided to the predetermined direction. By the discharge LED 7, the charges which are produced on the photosensitive layer 2*a* by the charging unit 3 and which correspond to the non-image formation region are removed before image data are transferred to the photosensitive layer 2*a* of the drum 2 by exposure.

As is apparent from FIG. 1, the squeeze rollers and the developing rollers are arcuately arranged along the outer circumference of the photosensitive drum. Each squeeze roller and the corresponding developing unit may be arranged in the same separation block, as shown in FIG. 1. The developing unit for each color may be manufactured independently of the others. In this case, the developing unit and the corresponding squeeze roller can be arranged in different separation blocks. This structure is advantageous in that the apparatus can be compact in size and the toner of each color does not mix with the toner of another color.

The liquid developer used in the developing device 5 will now be described.

The liquid developer is made up of toner particles of positively-chargeable type having diameters within the range of about 0.1 to 3 μm, a coloring agent, resin, additives of various kinds, and a carrier solution.

As the carrier solution, it is preferable to employ a high-resistance, low-viscosity insulating liquid. For example, isoparaffin hydrocarbon such as Isopar (trade name) commercially available from Exxon and normal-paraffin hydrocarbon such as Norpar (trade name) commercially available from Exxon. The additives include a charge control agent such as metallic soap, dispersant, etc. As the coloring agent, carbon and various kinds of colorants and pigments are used. As the resin, acrylic resin or styrene resin is used.

Figure 2:
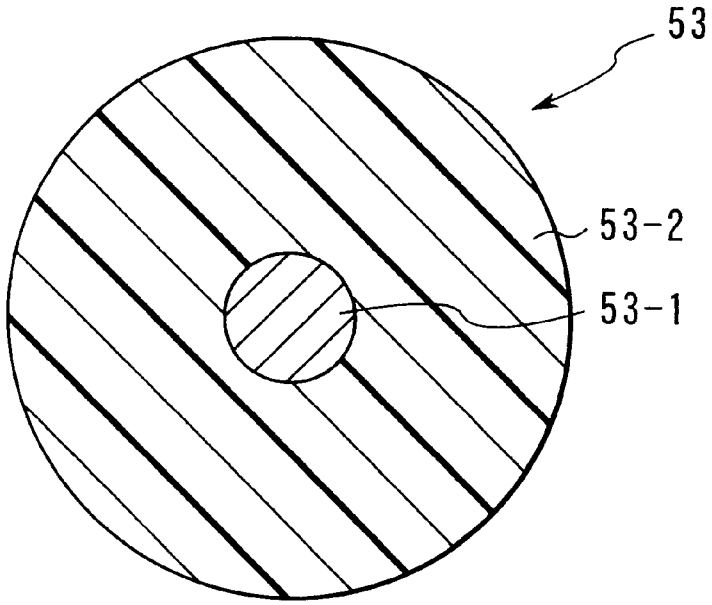
FIG. 2 is a schematic illustration showing an example of a squeeze roller which is incorporated in the developing device of the color image forming apparatus shown in FIG. 1.
Figure 3:
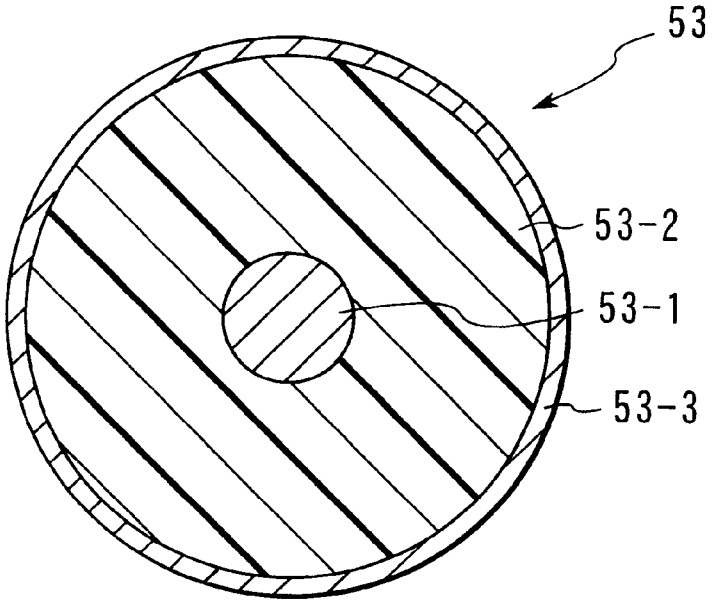
FIG. 3 is a schematic illustration showing another example of roller, which differs in type from the squeeze roller shown in FIG. 2.

FIGS. 2 and 3 are schematic illustrations showing a cross section of a roller that can be used as one of the squeeze rollers 53*a*–53*d*.

As shown in FIG. 2, the squeeze roller 53 is made up of a metallic shaft 53-1 and silicone rubber 53-2 (elastic layer) formed around the metallic shaft 53-1. The hardness of the silicon rubber 53-2 (elastic layer) is predetermined within the range of 30° to 60° in JISA. Not only the silicone rubber but also other kinds of rubber and foaming agents such as urethane can be used. The outer diameter of the elective layer 53-2 is 20 mm, for example. The conductivity of the elastic layer 53-2 can be controlled by adding a certain amount of carbon to the layer. To be more specific, the volume resistance is controlled to be within the range of 102 to $10^8$ Ωcm by the addition of carbon. In the present embodiment, the elastic layer 53-2 is formed of silicon rubber having a volume resistance of about $10^5$ Ωcm. It is desired that the roughness of the outer circumferential surface of the elastic layer 53-2 be less than 10 μm in Rz.

In practice, it is not easy to work the surface of silicone rubber to have a roughness of 3 μm or less. In consideration of this, the second embodiment described below has been conceived.

FIG. 3 shows another example of a roller than can be used as a squeeze roller. The roller shown in FIG. 3 is made up of a metallic shaft 53-1, silicone rubber provided around the metallic shaft 53-1, and a conductive resin layer 53-3 harder than the silicone rubber 53-2. In this embodiment, the outer diameter of the roller, including the thickness of the resin layer 53-3, is about 20 mm. The conductivity of the resin layer 53-3, like that of the elastic layer 53-2, is controlled by adding carbon to the layer. To be more specific, the volume resistance of the resin layer 53-3 is controlled to be within the range of $10^5$ to $10^9$ Ωcm by the addition of carbon. In the present embodiment, the resin layer 53-3 is formed of resin having a volume resistance of about $10^5$ Ωcm.

An example of the resin layer 53-3 is a PFA tube formed of fluoroplastic and having a thickness of about 50 μm. The PFA tube is not limited to fluoroplastic; it may be formed of polyimide resin, polycarbonate resin, or the like. In the present embodiment, fluoroplastic is used because it is improved in the repellence against the carrier solution. Since the resin layer 53-3 is formed as a resin tube, its surface roughness can be controlled to be less than 3 μm. The thickness of the resin layer 53-3 can be arbitrarily determined as long as the resin layer 53-3 is harder than the elastic layer (silicone rubber layer) 53-2. For example, the roller shown in FIG. 3 is made of a resin which is classified as having hardness D60 in D1706 of the ASTM. This hardness D60 of the resin corresponds to 90° to 100° of JISA.

Figure 4:
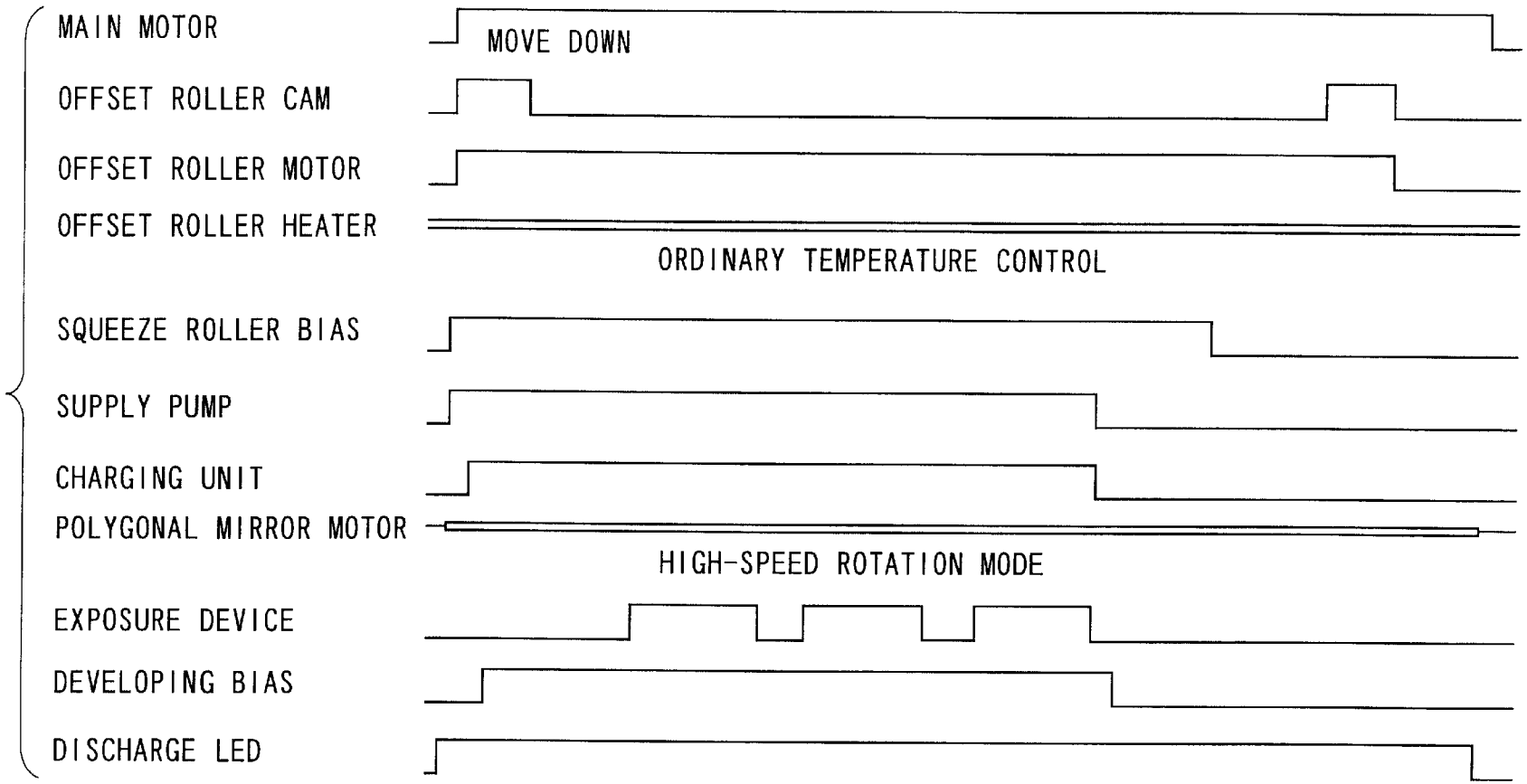
FIG. 4 is a timing chart which illustrates a control operation that can be applied to the image forming apparatus shown in FIG. 1.

FIG. 4 is a timing chart illustrating the operation of the image forming apparatus shown in FIG. 1.

Referring to FIG. 4, a main power supply switch (not shown) is turned on, and a warming-up operation is started. After the warming-up operation, the apparatus is set in a standby state, where the roller heater 6*a* of the offset roller 6 is kept at a predetermined constant temperature by ordinary temperature control. In the standby state of the apparatus, the photosensitive layer 2*a* of the photosensitive drum 2 and the offset roller 6 are kept separate from each other by a predetermined distance by means of an offset roller cam mechanism (not shown in the drawings).

In response to a print operation command entered from a control panel (not shown), a print operation is started. First of all, a first motor M1 and an offset roller motor M2 are turned on. Simultaneous with this, the squeeze roller 53*d* of the fourth developing unit 51*d* of the developing device 5 is applied with a predetermined bias voltage by the transformer 122. In addition, a developer supply pump (not shown) and the discharge LED 7 are turned on, and the polygon mirror motor 41 of the exposure unit 4 is driven. Shortly after, the actuation of motor M41, an offset roller cam (not shown) is turned on and brought into contact with the photosensitive layer 2*a* on the outer circumference of the photosensitive drum 2.

The photosensitive drum 2 is rotated at a predetermined rate, so that it can be cleared of charges by the discharge LED 7 prior to the execution of the image formation step.

In the meantime, the circulation of liquid developers is started in the developing device 5, and each of the developing units 51*a*, 51*b* and 51*c* is supplied with the corresponding one of the liquid developer supply units (not shown). To be more specific, the liquid developer supply pump (not shown) is actuated, and liquid developers of colors of Y, C, M and B are supplied from the liquid developer supply units (not shown) to the respective developing units. Extra amounts of liquid developers are returned to the corresponding liquid developer supply units.

Subsequently, the charging unit 3 located close to the outer circumference of the photosensitive drum 2 and the squeeze rollers 53*a*, 53*b* and 53*c* incorporated in the respective developing units start a charging operation. As a result, the photosensitive layer 2*a* of the photosensitive drum 2 is charged to have a predetermined potential. As described above, the predetermined bias voltage is applied to the squeeze roller 53*d* of developing unit 51*d*, which is located more downstream than any other developing units.

The developing rollers 52*a*, 52*b*, 52*c* and 52*d* of the developing units 51*a*, 51*b*, 51*c* and 51*d* are applied with a developing bias voltage by the high-voltage transformer 121, and a laser beam L, which has an output intensity determined in accordance with image data, is radiated from the exposure unit 4. As a result, an electrostatic latent image corresponding to the image data is formed on the photosensitive layer 2*a* of the photosensitive drum 2.

Developers are supplied from the liquid developer supply units to the electrostatic latent image formed on the photosensitive layer 2*a* of the photosensitive drum 2. Accordingly, the electrostatic latent image is developed with toners of four colors. Before being transferred to the electrostatic latent image, the toners are in the form of liquid developer layers which are formed on the developing rollers 52*a*, 52*b*, 52*c* and 52*d* and have a predetermined thickness.

Residual liquid developers, including toners that remain on the photosensitive layer 2*a* of the photosensitive drum 2 after the development of the electrostatic latent image, are separated from the photosensitive layer 2*a* of the drum 2 by the squeeze rollers located downstream of the respective developing rollers. The residual developers, thus separated from the photosensitive layer 2*a*, are returned to the liquid developer supply units by way of the separation blocks of the developing units by a liquid developer circulating pump (not shown). As explained above with reference to FIG. 1, each of the squeeze rollers 53*a*, 53*b*, 53*c* and 53*d* is pressed against the photosensitive layer 2*a* with predetermined pressure. With this structure, the liquid developers are collected in the corresponding liquid developer supply units without being conveyed to the downstream separation blocks. Accordingly, an abrupt decrease in the amount of developers available in the apparatus can be prevented.

After the four-color toner image is formed on the photosensitive layer 2*a* by the four developing units, the squeeze rollers 53*d* of the fourth developing unit 51*d* further squeezes a carrier solution out of the photosensitive layer. In addition, the four-color toner image is "set" on the photosensitive layer 2*a* of the photosensitive drum 2. The word "set" is intended to mean that the toner image is not moved or blurred even if the liquid developer flows or moves and thus ensures a reliable transfer operation.

After the developing operation by the last developing unit 51*d* comes to an end, the exposure unit 4 stops the radiation of a laser beam L. In addition, the operation by the liquid developer supply pump, the major charging by the charging unit 3, the application of a developing bias voltage to each of the developing rollers, and the application of a bias voltage to each of the squeeze rollers are stopped.

Thereafter, in accordance with the rotation of the photosensitive drum 2, the four-color toner image is conveyed toward the offset roller 6, and is then transferred from the photosensitive drum 2 to the surface of the offset roller 6.

After being transferred to the offset roller 6, the toner image (i.e., the developed electrostatic latent image) is moved to the final transfer region in accordance with the rotation of the offset roller 6. The final transfer region is a region where the offset roller 6 and the transfer auxiliary roller 8 are in contact with each other. The toner image is transferred onto a recording or transfer sheet 9, which is a medium that is then fed at predetermined timings (details of which are not described). The transfer auxiliary roller 8 is applied with a predetermined voltage by a high-voltage transformer, which applies a predetermined potential to the roller 8 under the control by the CPU 101. In this manner, the toner image is transferred from the offset roller 6 to the transfer sheet 9.

The transfer sheet 9 onto which the toner image is transferred is conveyed toward a fixing mechanism (not shown) in accordance with the rotation of the offset roller 6.

By the fixing mechanism, the toner image on the transfer sheet 9 is applied with heat and predetermined pressure. As a result, the toner is melted and fixed on the transfer sheet 9. On the photosensitive layer 2*a* of the photosensitive drum 2, there is a small amount of liquid developer (which is, for the most part, a carrier solution) that fails to be removed by the squeeze rollers of the developing units of the developing device 5. Although it is likely that the residual carrier solution will attach to the transfer material 9, such carrier solution is evaporated by the heat provided by the fixing mechanism.

The relationships between the surface roughness and the amount of residual carrier solution remaining on the photosensitive layer 2*a* are examined, with respect to the squeeze rollers 53*a*, 53*b* and 53*c* of the first, second and third developing units 51*a*, 51*b* and 51*c* and the squeeze roller 53*d* of the last developing unit 51*d*. In the case of a roller comprising only the elastic layer 53-2 shown in FIG. 2, the thickness of the residual carrier solution remaining on the photosensitive layer 2*a* was approximately 10 μm given that the roughness of the elastic layer 53-2 was 10 μm in Rz. For confirmation, an experiment was conducted by use of a squeeze roller wherein the roughness of the elastic layer 53-2 is roughened to 20 μm or so in Rz. In this experiment, the thickness of the residual carrier solution was as great as 20 μm. When a squeeze roller comprising the resin layer 53-3 shown in FIG. 3 was employed, the residual carrier solution remaining on the photosensitive layer 2*a* was as thin as about 1 μm. As an experiment for confirmation, the surface of the PFA tube 53-3 was worked to have a hardness of about 10 μm in Rz, and a squeeze roller having this PFA tube was employed. In this case, the thickness of the residual carrier solution remaining on the photosensitive layer 2*a* was in the range of 5 μm to 10 μm. When the surface layer 35-3 is made of a fluoroplastic tube having a hardness of D20, and the elastic layer 53-2 is made of a silicon rubber layer which is 50° in JISA, the surface roughness was less than 3 μm, but the thickness of the layer of the residual carrier solution was 10 μm or so. It was therefore found out that the residual carrier solution could not be squeezed out of the photosensitive layer when the surface layer of the squeeze roller was soft.

A description will now be given of the relationships between the diameters of toner particles and the bias voltage applied to each of the squeeze rollers.

If the diameters of toner particles are within the range of 2 to 3 μm, no serious problem occurs. If toner particles are smaller than the particles of this range, there may be a case where "darkening" in the background portion of a transfer medium (copy sheet) will become a problem.

For confirmation, an experiment was conducted, using toner whose particle diameters were in the range of 0.2 to 0.3 μm. In this case, it was admitted that the "darkening" in the background portion of the transfer medium could be larger than 2%. The "darkening" in the background portion is specifically represented as the difference between the reflection coefficient of the background portion of an image sample on a transfer medium and the reflection coefficient of an unused transfer medium. The measurement was made by use of a colorimeter commercially available from Minolta Co., Ltd.

To eliminate the "darkening" in the background portion of a transfer medium, a bias voltage was applied to each of the squeeze rollers, and the advantage of this voltage application was confirmed. In the experiment, the effects of the voltage application were examined, with the bias voltage varied. This experiment showed that the bias voltage was desirably positive and the absolute value thereof was smaller than that of the bias voltage applied to the upstream developing roller or rollers. For example, the "darkening" was 1% or less when the bias voltages to the developing and squeeze rollers were set at +500V and +200V, respectively. Needless to say, the adequate values of the bias voltages are dependent on the structure of the apparatus and the characteristics of the toner used, and they are in no way limited to specific values.

In general, a liquid developing system must be designed in such a way that a toner image is not blurred or distorted in the transfer process. To prevent the toner from moving before the toner image is transferred onto a transfer medium, a setting mechanism is proposed, which presses the elastic roller against the photosensitive drum so as to "set" the toner image on the surface of the photosensitive drum. The setting mechanism presently proposed is of a so-called setting roller type wherein a setting roller is provided independently of squeeze rollers, and this type of setting mechanism is disadvantageous in that an apparatus in which it is incorporated is inevitably large in size and cannot be manufactured at low cost.

In view of the above, the present invention employs conductive squeeze rollers. The volume resistance of the elastic layer or resin layer of each squeeze roller is set at $10^8$ Ω, and a voltage within the range of 800 to 1,200V. It was confirmed that these features suppressed distortion of a toner image at the time of a transfer operation.

The use of a squeeze roller comprising the squeeze roller shown in FIG. 3 enables an effective squeeze operation and reliable image formation (the setting of a toner image prior to the transfer operation). This will be described in detail.

In the squeeze roller shown in FIG. 3, the volume resistance of the elastic layer 53-2 is set at $10^5$ Ωcm, and the volume resistance of the PFA tube (the surface resin layer) is set at $10^8$ Ωcm. The first to third squeeze rollers, each made of such a squeeze roller, are set in the apparatus. The first to third squeeze rollers are pressed against the photosensitive layer 2*a* of the photosensitive drum 2 in such a manner that the total pressure applied by them is 4 kg. In this state, the first to third squeeze rollers are allowed to rotate in accordance with the rotation of the photosensitive drum 2. During the rotation, the photosensitive drum 2 is applied with a voltage which is +800V, has a frequency of 150 Hz, and obtained by the superposition between an AC voltage of +800V having a frequency of 150 Hz and an AC voltage having a sinusoidal wave and a peak-to-peak voltage is about 1,500V. Accordingly, the photosensitive layer 2*a* of the photosensitive drum 22 is charged to be +770V.

The squeeze roller 53*d*, which is arranged downstream of the developing roller 52*d* of the last developing unit 51*d*, comprises an elastic layer 53-2 whose volume resistance is set at $10^5$ Ωcm, and a PFA tube (the surface resin layer) 53-3 whose volume resistance is set at $10^8$ Ωcm. This squeeze roller is pressed against the photosensitive layer 2*a* of the drum 2 with a pressure of 4 Kg. By the squeeze roller 53*d*, the photosensitive layer 2*a* of the drum 2 is applied with a bias voltage of +1000V. Due to the application of the bias voltage, the toner image formed on the photosensitive layer 2*a* and conveyed toward the offset roller 6 can be agglomerated, thus preventing the toner image from being blurred at the time of transfer. This advantage is attributed to the phenomenon that the photosensitive layer 2*a* can be charged effectively in the portion located downstream of the nip width that is defined between the squeeze roller 53*d* and the photosensitive drum 2 since the residual carrier solution is squeezed out of the photosensitive drum 2 in the portion upstream of that nip width.

As described above, according to the present invention, a squeeze roller is provided for each of the developing units in such a manner that the squeeze roller is located downstream of the corresponding developing roller. With predetermined bias voltages being applied to the respective squeeze rollers, the residual carrier solution is squeezed out of the photosensitive drum. In addition, a transfer medium is prevented from becoming dark in the background portion thereof (i.e., a portion where no image is formed), despite the use of small-diameter toner particles. According to the present invention, moreover, the toner image can be agglomerated or set when the residual carrier solution is being squeezed out of the photosensitive drum. The photosensitive drum can also be charged at the same time.

The technology described above is applicable not only to the transfer system that uses an intermediate transfer body, such as an offset roller, but also to other types of transfer systems. For example, the technology is applicable to a direct transfer system that employs a corona charger and to various types of transfer mechanisms that employ intermediate transfer bodies and utilizes transfer electric fields.

The squeeze roller provided for the last developing unit and having a function of setting a toner image may be arranged as an independent squeeze roller that operates prior to the execution of the transfer step.

As described above, according to the present invention, squeeze rollers with which to squeeze a residual carrier solution out of the photosensitive drum are arcuately arranged along the outer circumference of the photosensitive drum, and each of the squeeze rollers is located downstream of the corresponding developing roller. With this structure, the apparatus is compact in size. In addition, the developers of different colors are prevented from mixing with one another. Moreover, each of the squeeze rollers is applied with a predetermined bias voltage. Due to the application of such a bias voltage, a transfer medium is prevented from becoming dark in the background portion thereof, despite the use of small-diameter toner particles, and this effect is compatible with the operation of squeezing the residual carrier solution out of the photosensitive drum. Moreover, the toner image can be agglomerated or set when the residual carrier solution is being squeezed out of the photosensitive drum. The photosensitive drum can also be charged at the same time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developing device which supplies a liquid developer including toner to an electrostatic image formed on an image bearer; and a squeeze roller including an elastic layer and a resin layer, a surface of said squeeze roller being moved in the same direction as a surface of the image bearer in a contact region where the squeeze roller is in contact with the image bearer, and serving to squeeze residual components of the liquid developer supplied to the electrostatic image from the developing device, the resin layer being harder than the elastic layer, wherein said resin layer has a surface roughness which is less than 3 $\mu$m in Rz.

2. The image forming apparatus according to claim 1, wherein the bias voltage applied to the squeeze roller is larger than 0V, and an absolute value thereof is smaller than that of a developing bias voltage applied to the developing device.

3. The image forming apparatus according to claim 2, further comprising a plurality of additional squeeze rollers, said additional squeeze rollers including a squeeze roller which is located most distant from the developing device in terms of a rotating direction of the image bearer and which is applied with a bias voltage whose absolute value is greater than that of the developing bias voltage applied to the developing device.

4. An image forming apparatus comprising:

a developing device which supplies a liquid developer including toner to an electrostatic image formed on an image bearer;

a squeeze roller including an elastic layer, a surface of said squeeze roller being moved in the same direction as a surface of the image bearer in a contact region where the squeeze roller is in contact with the image bearer, and serving to squeeze residual components of the liquid developer supplied to the electrostatic image from the developing device, said squeeze roller being applied with a predetermined bias voltage, and a plurality of additional squeeze rollers, said additional squeeze rollers including a squeeze roller which is located most distant from the developing device in terms of a rotating direction of the image bearer and which is applied with a bias voltage whose absolute value is greater than that of a developing bias voltage applied to the developing device.

5. The image forming apparatus according to claim 4, wherein the bias voltage applied to the squeeze roller is larger than 0V, and an absolute value thereof is smaller than that of a developing bias voltage applied to the developing device.

6. An image forming apparatus comprising:

a developing device which supplies a liquid developer including toner to an electrostatic image formed on an image bearer;

a squeeze roller including an elastic layer, a surface of said squeeze roller being moved in the same direction as a surface of the image bearer in a contact region where the squeeze roller is in contact with the image bearer, and serving to squeeze residual components of the liquid developer supplied to the electrostatic image from the developing device, said squeeze roller being applied with a predetermined bias voltage and serving to charge a photosensitive layer of the image bearer such that the photosensitive layer has a predetermined potential, and a plurality of additional squeeze rollers, said additional squeeze rollers including a squeeze roller which is located most distant from the developing device in terms of a rotating direction of the image bearer and which is applied with a bias voltage whose absolute value is greater than that of a developing bias voltage applied to the developing device.

7. The image forming apparatus according to claim 6, wherein the bias voltage applied to the squeeze roller is obtained by superposing a DC voltage on an AC voltage.

8. A squeeze roller for use with a developing device, comprising:

a metallic shaft serving as a rotating shaft;

a cylindrical elastic member made of rubber and provided around the outer circumference of the metallic shaft; and an outer sheath tube formed of a conductive resin which is harder than the elastic member, wherein said outer sheath has a surface roughness which is less than 3 $\mu$m in Rz.

9. The squeeze roller according to claim 8, wherein said outer sheath tube has a volume resistance which is in a range of $10^5$ to $10^9$ $\Omega$m.

10. An image forming apparatus comprising:

a developing device which supplies a liquid developer including toner to an electrostatic image formed on an image bearer; and a squeeze roller including an elastic layer, a surface of said squeeze roller being moved in the same direction as a surface of the image bearer in a contact region where the squeeze roller is in contact with the image bearer, and serving to squeeze residual components of the liquid developer supplied to the electrostatic image from the developing device, said squeeze roller being applied with a predetermined bias voltage and serving to charge a photosensitive layer of the image bearer such that the photosensitive layer has a predetermined potential, wherein the bias voltage applied to the squeeze roller is obtained by superposing a DC voltage on an AC voltage.

* * * * *